US008757988B2

(12) United States Patent
Fukudome et al.

(10) Patent No.: US 8,757,988 B2
(45) Date of Patent: Jun. 24, 2014

(54) CAPACITY CONTROL VALVE

(75) Inventors: Kohei Fukudome, Tokyo (JP); Ryosuke Cho, Tokyo (JP); Masayuki Futakuchi, Tokyo (JP)

(73) Assignee: Eagle Industry Co., Ltd. (JP)

( * ) Notice: Subject to any disclaimer, the term of this patent is extended or adjusted under 35 U.S.C. 154(b) by 134 days.

(21) Appl. No.: 13/501,723

(22) PCT Filed: Feb. 25, 2011

(86) PCT No.: PCT/JP2011/054281
§ 371 (c)(1),
(2), (4) Date: Apr. 12, 2012

(87) PCT Pub. No.: WO2011/135911
PCT Pub. Date: Nov. 3, 2011

(65) Prior Publication Data

US 2012/0198993 A1 Aug. 9, 2012

(30) Foreign Application Priority Data

Apr. 29, 2010 (JP) ..... 2010-104637

(51) Int. Cl.
*F04B 49/03* (2006.01)
*F04B 49/14* (2006.01)

(52) U.S. Cl.
USPC ..... 417/270; 91/505

(58) Field of Classification Search
USPC ..... 91/473, 482, 483, 504, 505, 506; 417/270, 271, 222.2, 222.1
See application file for complete search history.

(56) References Cited

U.S. PATENT DOCUMENTS

| | | | | |
|---|---|---|---|---|
| 6,772,990 | B2 * | 8/2004 | Sasaki et al. | 251/129.03 |
| 2009/0114871 | A1 | 5/2009 | Iwa | 251/318 |
| 2009/0183786 | A1 | 7/2009 | Iwa et al. | 137/487.5 |

FOREIGN PATENT DOCUMENTS

| | | | |
|---|---|---|---|
| CN | 101189432 | 5/2008 | F04B 27/14 |
| CN | 101410620 | 4/2009 | F04B 27/14 |
| EP | 1895161 | 3/2008 | F04B 27/14 |
| EP | 1995460 | 11/2008 | F04B 27/14 |
| JP | 2006002644 | 1/2006 | F04B 27/14 |
| JP | 2009057855 | 3/2009 | F04B 27/14 |
| KR | 20080025051 | 3/2008 | F04B 27/14 |
| WO | WO2006129753 | 7/2006 | F04B 27/14 |
| WO | WO2007119380 | 10/2007 | F04B 27/14 |

OTHER PUBLICATIONS

International Search Report and Written Opinion issued for corresponding application No. PCT/JP2011/054281, dated May 31, 2011 (10 pgs).
International Preliminary Report on Patentability issued for corresponding application No. PCT/JP2011/054281, dated Dec. 10, 2012 (7 pgs).

* cited by examiner

*Primary Examiner* — Bryan Lettman
(74) *Attorney, Agent, or Firm* — Hayes Soloway P.C.

(57) ABSTRACT

A capacity control valve for a variable-capacity compressor such as used in an air-conditioning system in a motor vehicle is provided, wherein foreign matter is prevented from being caught in the sliding parts and leakage on the sliding parts is prevented from occurring by configuring the capacity control valve so that there are no sliding parts between the valving element and the housing (valve body). The valve includes a bellows-type valve that includes a bellows and a fixing bracket joined in an airtight manner to an end of the bellows. The fixing bracket is fixed in an airtight manner to a valve body between a first valve chamber and a suction port.

3 Claims, 5 Drawing Sheets

Prior Art

CAPACITY CONTROL VALVE

TECHNICAL FIELD

The present invention relates to a capacity control valve for variably controlling the capacity or pressure of a working fluid, and particularly relates to a capacity control valve for controlling, in accordance with the pressure load, the discharge rate of a variable-capacity compressor or the like used in the air-conditioning system of a motor vehicle or the like.

BACKGROUND ART

A variable-capacity swash plate compressor used in the air-conditioning system of a motor vehicle or the like is provided with a rotating shaft rotatably driven by the rotational force of the engine, a swash plate linked to the rotating shaft so that the angle of inclination can be varied, a compression piston linked to the swash plate, and the like. In the compressor, the stroke of the piston is varied by varying the angle of inclination of the swash plate to control the discharge rate of the coolant gas.

The angle of inclination of the swash plate can be continuously varied by appropriately controlling the pressure in the control chamber and adjusting the state of balance of the pressure acting on both surfaces of the piston. This is achieved using a capacity control valve opened and closed by electromagnetic force while applying the suction pressure of the suction chamber for drawing in the coolant gas, the discharge pressure of the discharge chamber for discharging the coolant gas pressurized by the piston, and the control chamber pressure of the control chamber (crank chamber) for accommodating the swash plate.

FIG. 5 shows an example of a conventional capacity control valve (refer, for example, to Patent Document 1).

A capacity control valve 100 is constructed of a valve unit and a drive unit for opening and closing the valve unit. The valve unit has a cylindrical valve housing 101, and is formed by arranging a first pressure-sensitive chamber 102, a valve chamber 103, and a second pressure-sensitive chamber 107 in sequence in the axial direction in the interior. The first pressure-sensitive chamber 102 is in communication with a crank chamber via a communication hole 101*a* formed in the outside peripheral surface of the valve housing 101. The second pressure-sensitive chamber 107 is in communication with a suction chamber via a communication hole 101*e* formed in the outside peripheral surface of the valve housing 101. The valve chamber 103 is in communication with a discharge chamber via a communication hole 101*b* formed in the outside peripheral surface of the valve housing 101. The first pressure-sensitive chamber 102 and the valve chamber 103 can be in communication with each other via a valve hole 101*c*. A support hole 101*d* is formed between the valve chamber 103 and the second pressure-sensitive chamber 107.

A cylindrical valving element 104 is accommodated in the valve chamber 103. The valving element 104 can slide in the support hole 101*d* while the outside peripheral surface of the valving element 104 is in close contact with the inside peripheral surface of the support hole 101*d*, allowing the valving element 104 to move in the axial direction of the valve housing 101. One end of the valving element 104 can open and close the valve hole 101*c*, and the other end protrudes into the second pressure-sensitive chamber 107.

One end of a rod-shaped linking part 106 is fixed to one end of the valving element 104. The other end of the linking part 106 is disposed so as to be able to contact a bellows 105, and has the function of transmitting the displacement of the bellows 105 to the valving element 104.

The drive unit has a cylindrical solenoid housing 112. The solenoid housing 112 is coaxially linked to the other end of the valve housing 101, and a solenoid 114 is accommodated in the solenoid housing 112.

A control current is supplied to the solenoid 114, whereupon the solenoid 114 generates an electromagnetic force, attracts a moveable core 108 toward a fixed core 110, and acts on the valving element 104 in a closing direction.

The valving element 104 preferably has good operability because the capacity control valve is opened and closed by electromagnetic force and the pressure in the control chamber is appropriately controlled to control the capacity of the compressor while using the suction pressure of the suction chamber, the discharge pressure of the discharge chamber, and the control chamber pressure of the control chamber (crank chamber) of the variable-capacity swash plate compressor. The valving element 104 of a conventional capacity control valve has a structure in which the outside peripheral surface slides while in close contact with the inner peripheral surface of the support hole 101*d* formed between the second pressure-sensitive chamber 107, which is in communication with the suction chamber via the communication hole 101*e* of the valve housing 101, and the valve chamber 103, which is in communication with the discharge chamber via the communication hole 101*b*, as described above. This produces defects such as a hindrance to the movement of the valving element 104 when foreign matter is caught in the sliding parts, or an occasional stoppage of operation. In addition, when the clearance of the sliding parts is increased in order to prevent foreign matter from being caught in this manner, control fluid leaks via the sliding parts, and the designated control function of the compressor is adversely affected.

Ingress from the discharge chamber or the suction chamber can be considered as a pathway for foreign matter to be caught in the sliding parts of the support hole 101*d* and the valving element 104 of the capacity control valve 100, but the difference between the discharge pressure and the suction pressure suggests that the ingress primarily occurs from the discharge chamber. Assuming, for example, that the aperture dimensions of the meshes in the discharge filter is 160 μm, foreign matter having the same or smaller dimensions will be able to enter the sliding parts. Al, Fe, Si, and the like, which are used in compressor housings, can be cited as the materials constituting the foreign matter.

PRIOR ART DOCUMENTS

Patent Documents

Patent Document 1: JP-A 2009-57855

DISCLOSURE OF THE INVENTION

Problems to Be Solved by the Invention

An object of the present invention, which was devised in order to solve the problems with the above-described conventional capacity control valve, is to provide a capacity control valve wherein foreign matter is prevented from being caught in the sliding parts, and leakage on the sliding parts is prevented from occurring, in a valving element for opening and closing the space between the valve chamber, which is in communication with the discharge chamber of the compressor, and the pressure-sensitive chamber, which is in communication with the control chamber (crank chamber), by configuring the valving element so that there are no sliding parts between the valving element and the housing (valve body).

Means to Solve the Aforementioned Problems

Aimed at achieving the aforementioned object, the capacity control valve according to a first aspect of the present invention is characterized in comprising:

a discharge-side passage for providing communication between a discharge chamber for discharging a fluid, and a control chamber for controlling the discharge rate of the fluid;

a first valve chamber formed in the middle of the discharge-side passage;

a suction-side passage for providing communication between a suction chamber for drawing in the fluid and the control chamber;

a suction port formed in the middle of the suction-side passage;

a first valving element for opening and closing the discharge-side passage in the first valve chamber;

a second valve chamber formed nearer to the control chamber and away from the first valve chamber in the middle of the suction-side passage;

a pressure-sensitive body disposed in the second valve chamber, the pressure-sensitive body exerting an urging force in a direction for opening the first valving element by elongation, and undergoing constriction in accordance with an increase in the surrounding pressure;

an adapter provided to a free end of the pressure-sensitive body in the elongation and constriction direction, the adapter having an annular bearing surface;

a second valving element linked to the first valving element and provided with an annular engaging surface for opening and closing the suction-side passage by engagement with, and disengagement from, the bearing surface of the adapter in the second valve chamber; and a solenoid for exerting an electromagnetic driving force on the first valving element;

wherein a bellows-type valve that uses a bellows is adopted in the first valving element.

According to the first aspect, problems such as the catching of foreign matter in the sliding parts and leakage on the sliding parts, which occur in conventional capacity control valves, are completely resolved because of the absence of sliding parts between the valving element and the valve body.

The capacity control valve according to a second aspect of the present invention is the capacity control valve of the first aspect characterized in that the bellows-type valve comprises a main body part in contact with the bearing surface of the discharge-side passage, a bellows in which one end is joined in an airtight manner to the rear surface of the main body part, and a fixing bracket joined in an airtight manner to the other end of the bellows, wherein the fixing bracket is fixed in an airtight manner to a valve body between the first valve chamber and the suction port.

According to the second aspect, leakage between the discharge side and the suction side can be substantially completely prevented.

The capacity control valve according to a third aspect of the present invention is the capacity control valve of the second aspect characterized in that the pressure-receiving surface area B1 at the seal diameter of the first valving element and the pressure-receiving surface area C1 at the effective diameter of the bellows of the first valving element are made equal to each other.

According to the third aspect, the discharge pressure Pd acting on the first valving element can be canceled out to prevent the effect thereof, the first valving element can operate without being affected by the discharge pressure Pd, and capacity can be controlled in a stable manner.

Effect of the Invention

The present invention has the following remarkable effects.

(1) Adopting a bellows-type valve that uses a bellows in the first valving element for opening and closing the discharge-side passage in the capacity control valve allows problems such as the catching of foreign matter in the sliding parts and leakage on the sliding parts, which occur in conventional capacity control valves, to be completely resolved because of the absence of sliding parts between the valving element and the valve body.

(2) The bellows-type valve comprises a main body part in contact with the bearing surface of the discharge-side passage, a bellows in which one end is joined in an airtight manner to the rear surface of the main body part, and a fixing bracket joined in an airtight manner to the other end of the bellows, wherein the fixing bracket is fixed in an airtight manner to a valve body between the first valve chamber and the suction port. Leakage between the discharge side and the suction side can thereby be substantially completely prevented.

(3) The pressure-receiving surface area B1 at the seal diameter of the first valving element and the pressure-receiving surface area C1 at the effective diameter of the bellows of the first valving element are made equal to each other, whereby the discharge pressure Pd acting on the first valving element can be canceled out to prevent the effect thereof, the first valving element can operate without being affected by the discharge pressure Pd, and capacity can be controlled in a stable manner.

BEST MODE FOR CARRYING OUT THE INVENTION

The modes of working the capacity control valve according to the present invention are described in detail below with reference to the drawings, but various changes, modifications, and improvements are possible within the scope of the present invention based on the knowledge of one skilled in the art, without limiting the interpretation of the present invention.

Figure 1:
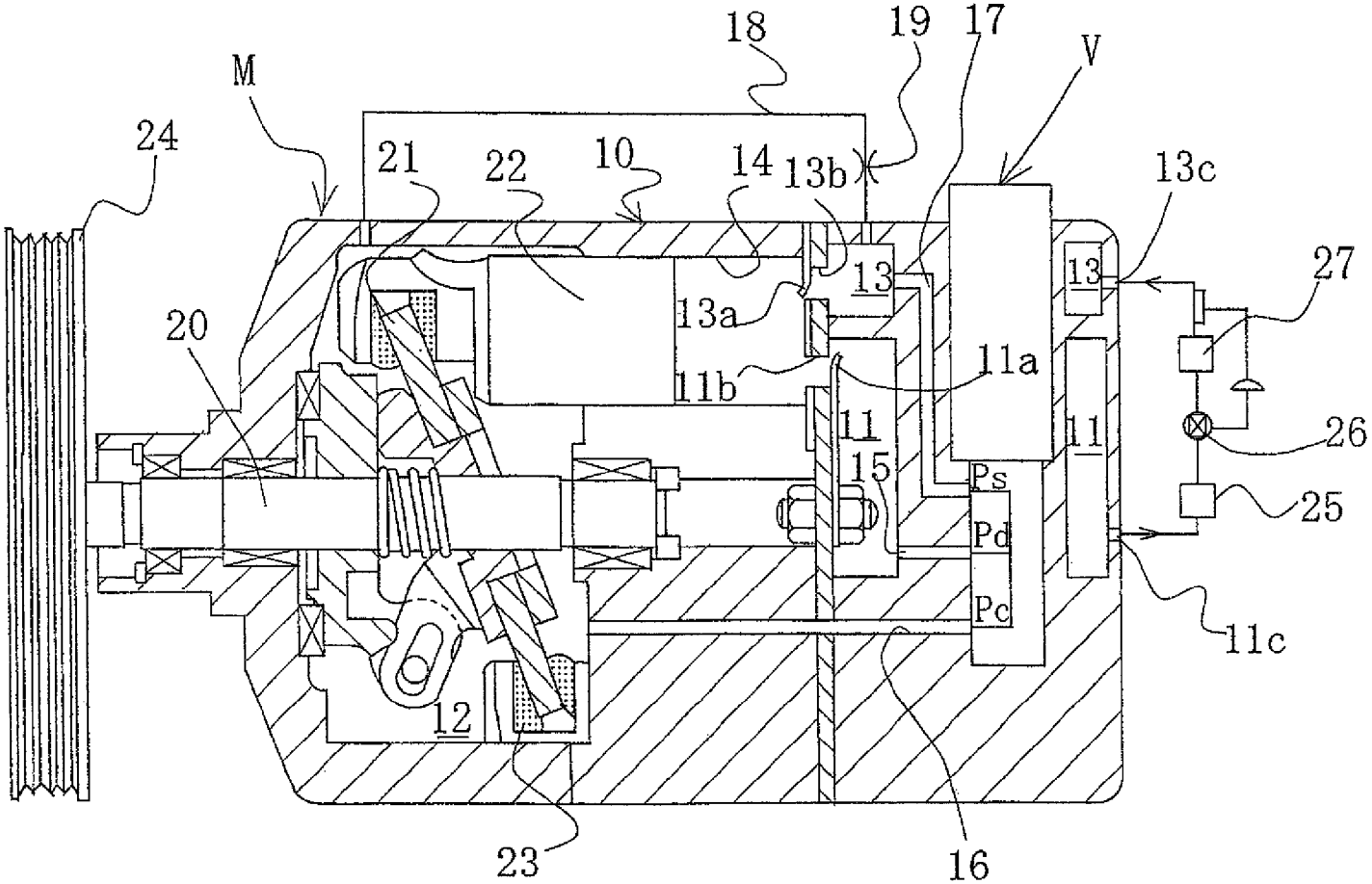
FIG. 1 is a schematic structural view showing a variable-capacity swash plate compressor provided with a capacity control valve according to the present invention.

A variable-capacity swash plate compressor M is provided with a discharge chamber 11, a control chamber (also referred to as a crank chamber) 12, a suction chamber 13, a plurality of cylinders 14, a port 11*b* opened and closed by a discharge valve 11*a* and used to provide communication between the cylinders 14 and the discharge chamber 11, a port 13*b* opened and closed by a suction valve 13*a* and used to provide communication between the cylinders 14 and the suction chamber 13, a discharge port 11*c* and a suction port 13*c* connected to an external cooling circuit, a communication passage 15 used as a discharge-side passage for providing communication between the discharge chamber 11 and the control chamber 12, a communication passage 16 doubling as the aforementioned discharge-side passage and as a suction-side passage for providing communication between the control chamber 12 and the suction chamber 13, a casing 10 for defining a communication passage 17 or the like as a suction-side passage, a rotating shaft 20 rotatably provided so as to protrude from the inside of the control chamber (crank chamber) 12 to the outside, a swash plate 21 integrally rotated with the rotating shaft 20 and linked to the rotating shaft 20 so that the angle of inclination can be varied, a plurality of pistons 22 fitted in a reciprocating manner inside each of the cylinders 14, a plurality of linking members 23 for linking each of the pistons 22 with the swash plate 21, a driven pulley 24 attached to the rotating shaft 20, a capacity control valve V of the present invention incorporated into the casing 10, and the like, as shown in FIG. 1.

In addition, a communication passage 18 for direct communication between the control chamber (crank chamber) 12 and the suction chamber 13 is provided to the variable-capacity swash plate compressor M, and a fixed orifice 19 is provided to the communication passage 18.

Moreover, the cooling circuit is connected to the discharge port 11*c* and the suction port 13*c* in the variable-capacity swash plate compressor M, and a condenser (condensing device) 25, an expansion valve 26, and an evaporator (evaporating device) 27 are provided in a sequential arrangement to the cooling circuit.

Figure 2:
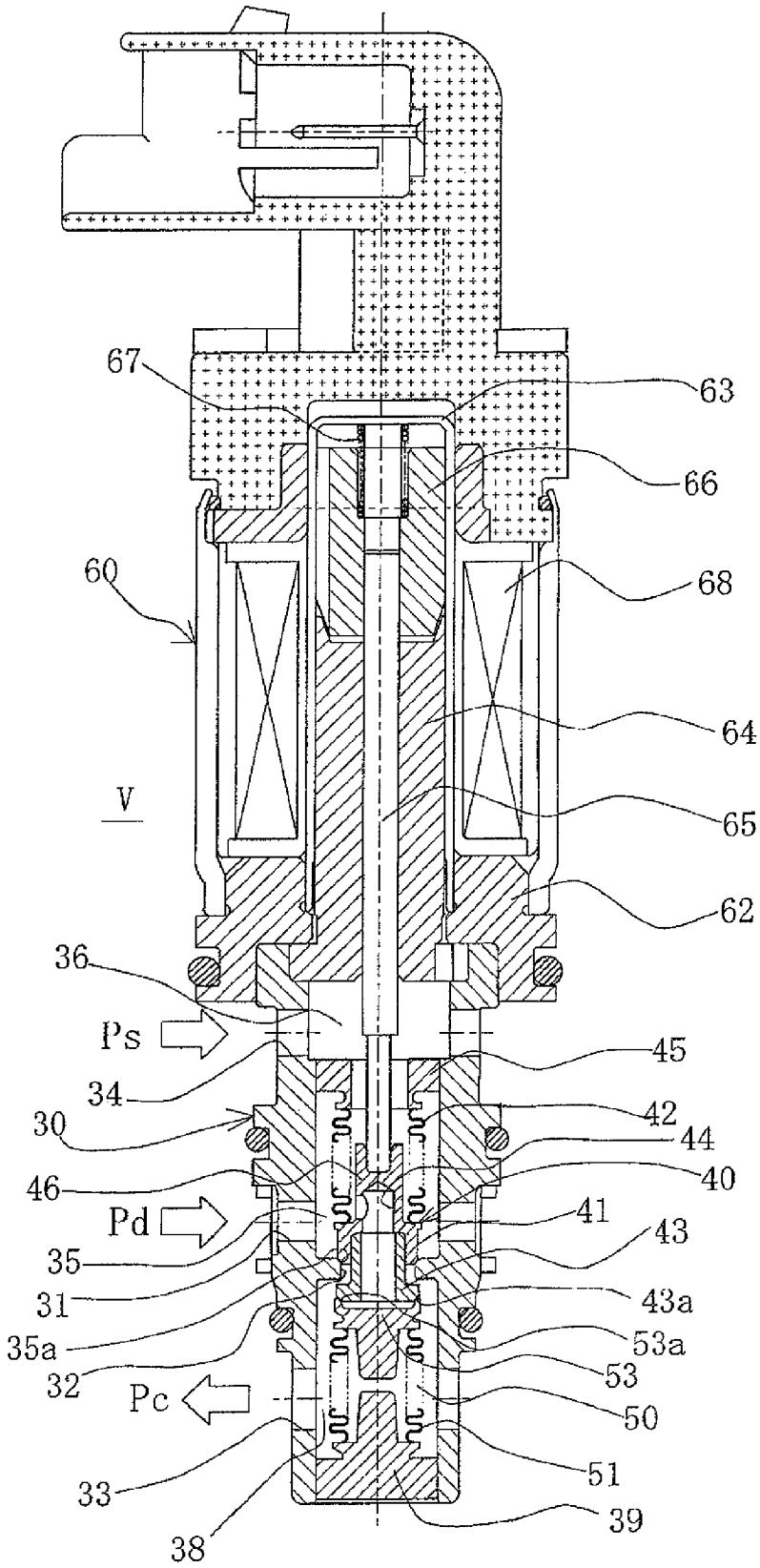
FIG. 2 is a front cross-sectional view showing an embodiment of the capacity control valve according to the present invention.

The capacity control valve V is provided with a valve body 30 formed of a metal material or a resin material, a first valving element 40 disposed inside the valve body 30, a pressure-sensitive body 50 for urging the first valving element 40 in one direction, a solenoid 60 connected to the valve body 30 and used to exert an electromagnetic driving force on the first valving element 40, and the like, as shown in FIG. 2.

The valve body 30 is provided with communication passages 31, 32, 33 functioning as discharge-side passages, communication passages 33, 34 functioning as suction-side passages together with a below-described communication passage 44 of the first valving element 40, a first valve chamber 35 formed in the middle of the discharge-side passage, a suction port 36 formed in the middle of the suction-side passage, a second valve chamber 38 formed near the control chamber 12 of the discharge-side passage and the suction-side passage, and the like.

In addition, a blocking member 39 that defines the second valve chamber 38 and constitutes a part of the valve body 30 is attached to the valve body 30 by threadable engagement.

Specifically, the communication passage 33 and the second valve chamber 38 are formed so as to double as a part of the discharge-side passage and the suction-side passage, and the communication passage 32 forms a valve hole for providing communication between the first valve chamber 35 and the second valve chamber 38 and allowing a second valving element 43 linked to the first valving element 40 to pass through (allowing the second valving element 43 to pass through while maintaining a gap for the flow of the fluid).

The communication passages 31, 33, 34 are each arranged in a radial shape in a circumferential direction, and are formed in a plural number (for example, four passages at intervals of 90°).

A bearing surface 35*a* on which a main body part 41 of the below-described first valving element 40 rests is formed on an edge part of the communication passage (valve hole) 32 in the first valve chamber 35.

The first valving element 40 is provided with the main body part 41 capable of resting on the bearing surface 35*a* of the valve hole 32, a bellows 42 in which one end is joined in an airtight manner to the rear surface of the main body part 41, and a fixing bracket 45 joined in an airtight manner to the other end of the bellows 42. The fixing bracket 45 is fixed in an airtight manner to the valve body 30 between the first valve chamber 35 and the suction port 36. This produces a structure in which the first valve chamber 35 and the suction port 36 are blocked off in an airtight manner by the first valving element 40.

A linking part 46 linked to a drive rod 65 of the solenoid 60 is formed at the rear surface of the main body part 41, and a link with an end part of the drive rod 65 is formed on the linking part 46.

In addition, the second valving element 43, which is disposed so as to pass through the valve hole 32 and extend to the second valve chamber 38, is linked by being mounted to the front surface of the main body part 41.

Moreover, the communication passage 44, which passes through from the suction port 36 to the second valve chamber 38 in the axial direction and functions as a suction-side passage, is formed in the main body part 41 and the second valving element 43.

The second valve part 43 is formed so as to increase in diameter from a narrowed state in the direction from the first valve chamber 35 toward the second valve chamber 38 to allow the communication passage (valve hole) 32 to pass through, and is provided with an annular engaging surface 43*a* facing a below-described adapter 53 on the outside peripheral edge of the widened portion.

In FIG. 2, the pressure-sensitive body 50 is provided with a bellows 51, the adapter 53, and the like. One end of the bellows 51 is fixed to the blocking member 39, and the other end (free end) holds the adapter 53.

The adapter 53 is provided with an annular bearing surface 53*a* for engaging with and disengaging from the engaging surface 43*a* of the second valving element 43 in a facing arrangement at the distal end thereof.

Specifically, the pressure-sensitive body 50 is disposed in the second valve chamber 38 and operates so as to exert an urging force in a direction for opening the first valving element 40 by elongation (expansion), and undergo constriction in accordance with an increase in the surrounding pressure (inside the communication passage 44 of the second valve chamber 38 and the first valving element 40) to reduce the urging force exerted on the first valving element 40.

Figure 3:
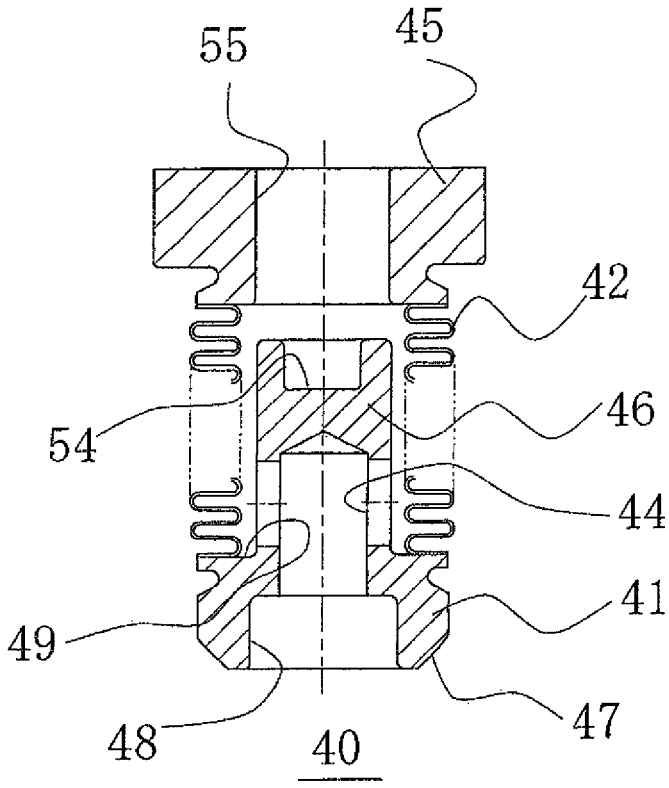
FIG. 3 is a cross-sectional view showing, in an enlarged form, a first valving element in the capacity control valve according to the present invention.

FIG. 3 is an enlarged cross-sectional view of the first valving element 40.

The main body part 41 of the first valving element 40 has a shape resembling a bolt formed of a head and a shank. A spherical part 47 capable of resting on the bearing surface 35*a* of the valve hole 32 is formed on the outside peripheral edge of the portion corresponding to the head, and a concavity 48 for providing linkage with the second valving element is formed on the center part of the portion corresponding to the head. The linking part 46 linked to the drive rod 65 is formed on the portion corresponding to the shank, and one end of the bellows 42 is joined in an airtight manner by welding to a stepped part 49 of the head and the shank.

A concavity 54 for providing linkage with the drive rod 65 is formed on the end part of the linking part 46, and the communication passage 44 is formed on the inside part of the head and the shank.

The bellows 42 is extended from the stepped part 49 so as to cover the linking part 46, and is joined in an airtight manner on the other end by welding to the side face of the fixing bracket 45. The fixing bracket 45 has a doughnut shape and is fixed in an airtight manner by press-fitting the outside peripheral surface to the valve body 30. The first valve chamber 35 and the suction port 36 are therefore separated in an airtight manner by the first valving element 40, while a fluid passage for providing communication between the suction port 36 and the second valve chamber 38 is formed by a hole 55 in the fixing bracket 45 of the first valving element 40, the space between the inside of the bellows 42 and the outside of the linking part 46, the communication passage 44 of the linking part 46, and the communication passage 44 of the second valving element. In addition, the main body part 41 of the first valving element 40 and the bellows 42 are disposed with a gap relative to the valve body 30 in the first valve chamber 35. Accordingly, when the first valving element 40 is operated by being driven using the drive rod 65, problems such as leakage on the sliding parts or the catching of foreign matter in the sliding parts do not arise in the manner observed in conventional capacity control valves because of the absence of parts that slide against the valve body 30.

The solenoid 60 is provided with a casing 62 linked to the valve body 30, a sleeve 63 in which one end part is closed, a cylindrical fixed iron core 64 disposed inside the casing 62 and the sleeve 63, a drive rod 65 disposed in the fixed iron core 64 in a reciprocating manner and arranged so that the distal end thereof is linked to the first valve element 40 to form the communication passage 44, a moveable iron core 66 fixedly attached to the other end of the drive rod 65, a coil spring 67 for urging the moveable iron core 66 in the direction that closes the first valve part 40, an excitation coil 68 wound on the outside of the sleeve 63 via a bobbin, and the like, as shown in FIG. 2.

Figure 4:
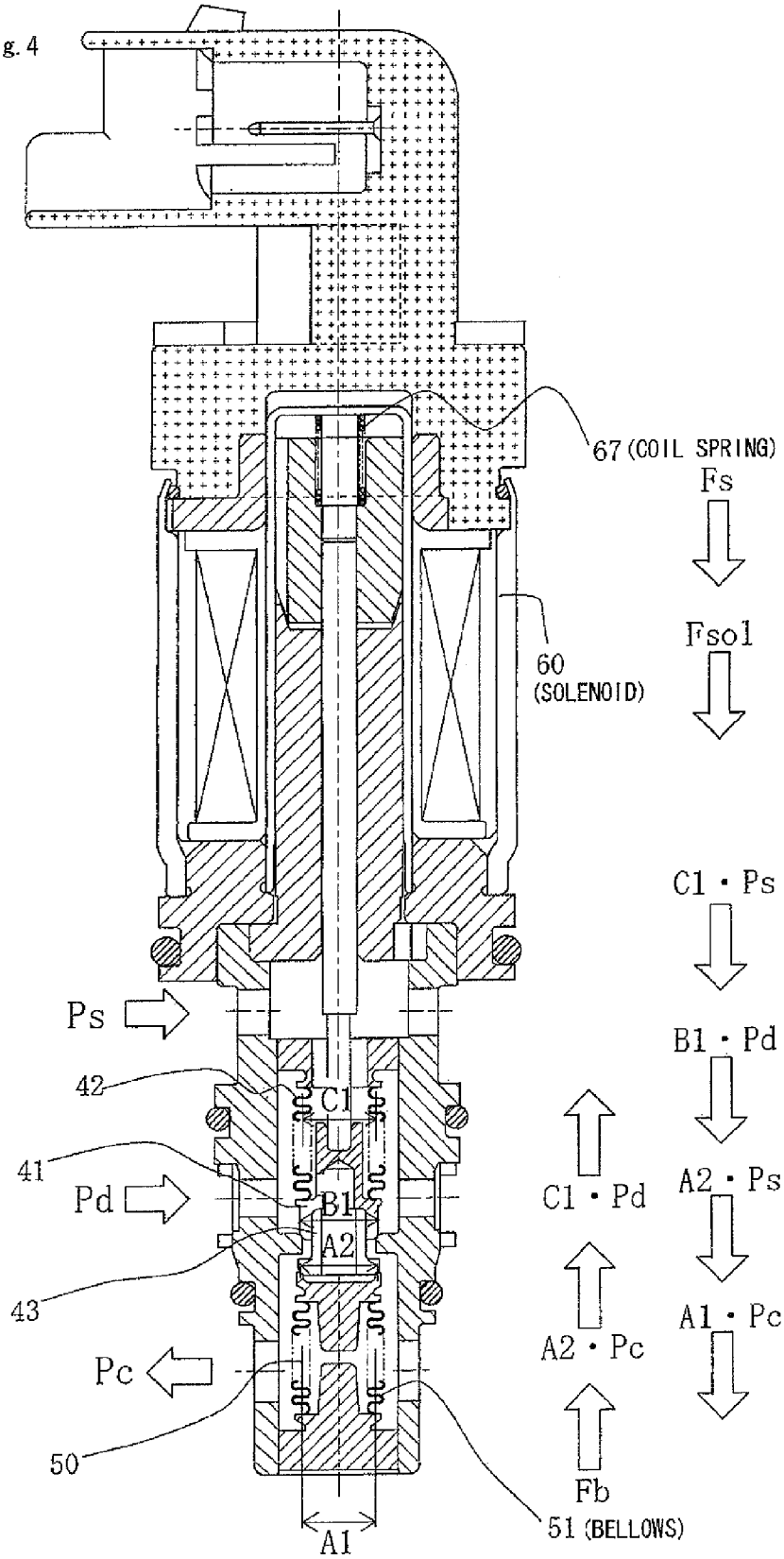
FIG. 4 is an explanatory view showing the equilibrium relationship of the forces acting on a valving element of the capacity control valve according to the present invention.
Figure 5:
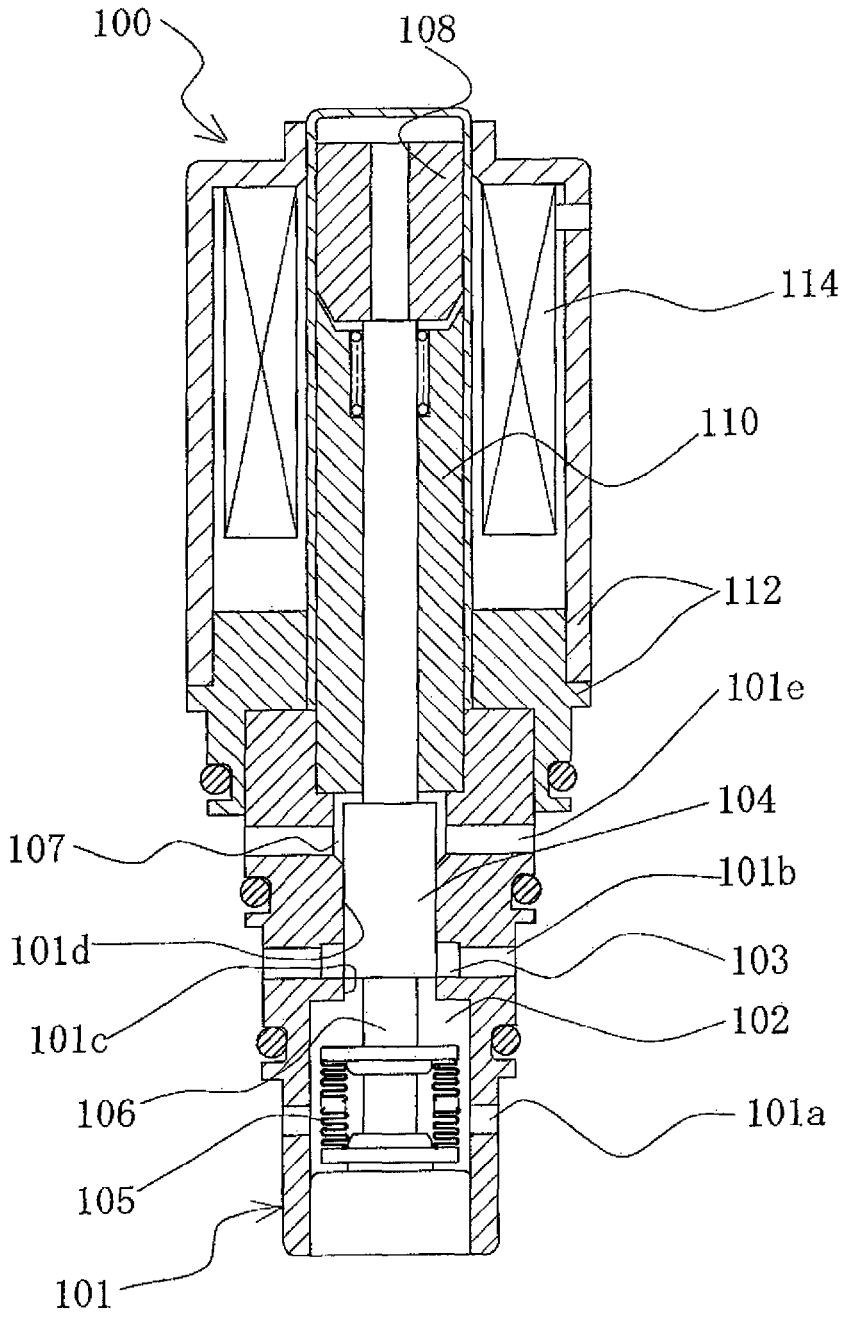
FIG. 5 is a front cross-sectional view showing a conventional capacity control valve.

In the above-described structure, the formula for the equilibrium relationship of the force acting on the first valving element 40 is as shown below, where A1 is the pressure-receiving surface area of (the bellows 51 of) the pressure-sensitive body 50 at the effective diameter, A2 is the pressure-receiving surface area of the second valving element 43 at the seal diameter, B1 is the pressure-receiving surface area of the first valving element 40 at the seal diameter, C1 is the pressure-receiving surface area of the bellows 42 of the first valving element 40 at the effective diameter, Fb is the urging force of the pressure-sensitive body 50, Fs is the urging force of the coil spring 67, Fsol is the urging force due to the electromagnetic driving force of the solenoid 60, Pd is the discharge pressure of the discharge chamber 11, Ps is the suction pressure of the suction chamber 13, and Pc is the control chamber pressure of the control chamber (crank chamber) 12, as shown in FIG. 4.

$$Fb+A2\cdot Pc+C1\cdot Pd=A1\cdot Pc+A2\cdot Ps+B1\cdot Pd+C1\cdot Ps+Fsol+Fs$$

Now, if A1=A2=B1=C1=A, then $$Fb=2A\cdot Ps+Fsol+Fs,$$

and stable control is possible without the effect of the pressure Pd and Pc.

Specifically, the control chamber pressure Pc acting on the pressure-sensitive body 50 in the second valve chamber 38 can be canceled out by making the pressure-receiving surface area A1 and the pressure-receiving surface area A2 equal to each other. The effect of the pressure can be prevented, the first valving element 40 can operate without being affected by the control chamber pressure Pc, and capacity can be controlled in a stable manner.

In addition, the discharge pressure Pd acting on the first valving element 40 can be canceled out by making the pressure-receiving surface area B1 and the pressure-receiving surface area C1 equal to each other. The effect of the pressure can be prevented, the first valving element 40 can operate without being affected by the discharge pressure Pd, and capacity can be controlled in a stable manner.

In the above-described structure, the formula for the equilibrium relationship when the coil 68 is unpowered is as shown below.

$$Fb=2A\cdot Ps+Fs$$

The first valving element 40 is moved upward in FIG. 2, and the main body part 41 of the first valving element 40 is separated from the bearing surface 35*a* to open the communication passages (discharge-side passages) 31, 32.

When the coil 68 is powered at or above a preset electric current value (I), the first valving element 40 is moved downward in FIG. 2 by the electromagnetic driving force (urging force) of the solenoid 60 acting in the opposite direction to the urging force of the pressure-sensitive body 50 and by the urging force of the coil spring 67, and the main body part 41 rests on the bearing surface 35*a* to block the communication passages (discharge-side passages) 31, 32.

However, the operation of the first valving element 40 is controlled by the suction chamber pressure Ps. Therefore, the main body part 41 of the first valving element 40 rests on the bearing surface 35*a* to block the communication passages (discharge-side passages) 31, 32, even when the coil 68 is unpowered, which is different from the above-described state. This occurs in cases, in which for example, the suction chamber pressure Ps reaches or surpasses an established pressure. In addition, when the suction chamber pressure Ps reaches or decreases below an established pressure, the first valving element 40 is moved upward in FIG. 2, and the main body part 41 of the first valving element 40 is separated from the bearing surface 35*a* to open the communication passages (discharge-side passages) 31, 32, even when the coil 68 is powered.

An operation in which a variable-capacity swash plate compressor M provided with the capacity control valve V is applied to an air-conditioning system of a motor vehicle is described below.

The rotating shaft 20 is first rotated via a transmission belt (not shown) and the driven pulley 24 by the rotary driving force of the engine, whereupon the swash plate 21 rotates integrally with the rotating shaft 20. When the swash plate 21 rotates, the piston 22 reciprocates in the cylinder 14 at a stroke corresponding to the angle of inclination of the swash plate 21, and a coolant gas drawn into the cylinder 14 from the suction chamber 13 is compressed by the piston 22 and discharged to the discharge chamber 11. The discharged coolant gas is supplied to the evaporator 27 from the condenser 25 via the expansion valve 26, and the gas returns to the suction chamber 13 while a cooling cycle is performed.

Here, the discharge rate of the coolant gas is determined by the stroke of the piston 22, and the stroke of the piston 22 is determined by the angle of inclination of the swash plate 21 controlled by the pressure inside the control chamber 12 (control chamber pressure Pc).

During compression of the piston 22, blowby gas from the clearance between the piston 22 and the cylinder 14 constantly flows toward the control chamber 12 and causes the pressure Pc of the control chamber 12 to increase. However, pressure is discharged at a constant rate from the control chamber 12 to the suction chamber, and the pressure in the control chamber 12 can be appropriately maintained, even when the communication passages (suction-side passages) 33, 44, 34 are closed because a fixed orifice 19 is provided.

First, turning off the solenoid 60 and keeping the suction pressure Ps low brings about a state in which the second valving element 43 rests on the bearing surface 53*a* of the adapter 53 without constriction of the bellows 51. In addition, a state is established in which the liquid refrigerant is accumulated in the control chamber 12 because the main body part 41 of the first valving element 40 is separated from the bearing surface 35*a* to open the communication passages 31, 32.

When the solenoid 60 is turned on in this state, the first valving element 40 moves in the closing direction, and the main body part 41 rests on the bearing surface 35*a* to block the communication passages (discharge-side passages) 31, 32. When the intake pressure Ps reaches or surpasses an established pressure after startup, the bellows 51 is constricted, the adapter 53 is disengaged from the second valving element 43, and a state is established in which the suction-side communication passages 33, 44, 34 are opened. The liquid refrigerant accumulated in the control chamber 12 is then discharged to the suction chamber 13 by way of the communication passages (suction-side passages) 33, 44, 34. When the discharge of the liquid refrigerant in the control chamber 12 is finished and the control chamber pressure Pc reaches or decreases below an established pressure, the bellows 51 elongates, and the second valving element 43 rests on a bearing surface 53*a* of the adapter 53. Accordingly, a state is established in which the communication passages (suction-side passages) 33, 44, 34 are blocked.

The elongation of the bellows 51 is controlled by the suction pressure Ps and the control chamber pressure Pc. Therefore, the bellows 51 is constricted, the adapter 53 disengages from the second valving element 43, and a state is established in which the suction-side passages 33, 44, 34 are opened when the suction pressure Ps reaches or surpasses an established, regardless of whether the solenoid is turned on or off. The liquid refrigerant accumulated in the control chamber 12 is then discharged to the suction chamber 13 by way of the communication passages (suction-side passages) 33, 44, 34. Accumulation of the liquid refrigerant in the control chamber 12 can thus be made more difficult, and the stroke of the piston 22 can be rapidly brought to a maximum.

During regular control (between maximum-capacity operation and minimum-capacity operation), the magnitude of the electric power provided to the solenoid 60 (coil 68) is appropriately controlled to vary the electromagnetic driving force (urging force). Specifically, the position of the first valving element 40 is appropriately adjusted by the electromagnetic driving force, and the opening rate is controlled so as to attain the desired discharge rate.

In addition, in a minimum-capacity operation state, the solenoid 60 (coil 68) is unpowered, and the moveable iron core 66 and the drive rod 65 are retracted and stopped in a resting position by the urging force of the pressure-sensitive body 50. The main body part 41 of the first valving element 40 is separated from the bearing surface 35*a* to open the communication passages (discharge-side passages) 31, 32. The discharge fluid (discharge pressure Pd) is thereby supplied inside the control chamber 12 through the communication passages (discharge-side passages) 31, 32, 33. The angle of inclination of the swash plate 21 is then controlled so as to be greatly reduced, and the stroke of the piston 22 reaches a minimum. As a result, the discharge rate of the coolant gas is at a minimum.

In the capacity control valve shown in FIG. 2, a valving element is not provided to the suction port 36, and the communication passage 44 is configured to be, in constant communication with the suction chamber 13 of the variable-capacity compressor. It is apparent, however, that a valving element that interlocks with the first valving element 40 to open and close the communication between the suction chamber 13 and the communication passage 44 may be provided.

EXPLANATION OF NUMERALS AND CHARACTERS

10 Casing
11 Discharge chamber
12 Control chamber (crank chamber)
13 Suction chamber
14 Cylinder
15 Communication passage
16 Communication passage
17 Communication passage
18 Communication passage
19 Fixed orifice
20 Rotating shaft
21 Swash plate
22 Piston
23 Linking member
24 Driven pulley
25 Condenser (condensing device)
26 Expansion valve
27 Evaporator (evaporating device)
30 Valve body
31, 32 Communication passage (discharge-side passage)
33 Communication passage (control chamber-side passage)
34 Communication passage (suction-side passage)
35 First valve chamber
35*a* Bearing surface
36 Suction port
38 Second valve chamber
39 Blocking member
40 First valving element
41 Main body part
42 Bellows
43 Second valving element
43*a* Engaging surface
44 Communication passage
45 Fixing bracket
46 Linking part
47 Spherical part
48 Concavity
49 Stepped part
50 Pressure-sensitive body
51 Bellows
53 Adapter
53*a* Bearing surface
54 Concavity
55 Hole
60 Solenoid
62 Casing
63 Sleeve
64 Fixed iron core
65 Drive rod

66 Moveable iron core
67 Coil spring
68 Excitation coil
M Variable-capacity swash plate compressor
V Capacity control valve
Pd Discharge pressure
Ps Suction pressure
Pc Control chamber pressure
A1 Pressure-receiving surface area of pressure-sensitive body
A2 Pressure-receiving surface area of second valving element
B1 Pressure-receiving surface area of first valving element
C1 Pressure-receiving surface area of bellows of first valving element

The invention claimed is:

1. A capacity control valve comprising:

a discharge-side passage for providing communication between a discharge chamber for discharging a fluid, and a control chamber for controlling the discharge rate of the fluid;

a first valve chamber formed in the middle of said discharge-side passage;

a suction-side passage for providing communication between a suction chamber for drawing in the fluid and said control chamber;

a suction port formed in the middle of said suction-side passage;

a first valving element for opening and closing said discharge-side passage in said first valve chamber;

a second valve chamber formed between said control chamber and said first valve chamber in the middle of said suction-side passage;

a pressure-sensitive body disposed in said second valve chamber, said pressure-sensitive body exerting an urging force in a direction for opening said first valving element by elongation, and undergoing constriction in accordance with an increase in the surrounding pressure;

an adapter provided to a free end of said pressure-sensitive body in the elongation and constriction direction, said adapter having an annular bearing surface;

a second valving element linked to said first valving element and provided with an annular engaging surface for opening and closing said suction-side passage by engagement with, and disengagement from, the bearing surface of said adapter in said second valve chamber; and a solenoid for exerting an electromagnetic driving force on said first valving element;

wherein a bellows-type valve that uses a bellows is adopted in said first valving element, and a fixing bracket joined in an airtight manner to the other end of the bellows; and wherein the fixing bracket is fixed in an airtight manner to a valve body between said first valve chamber and said suction port.

2. The capacity control valve of claim 1, wherein the bellows-type valve comprises a main body part in contact with a bearing surface of the discharge-side passage, and a bellows in which one end is joined in an airtight manner to a rear surface of the main body part.

3. The capacity control valve of claim 2, wherein the pressure-receiving surface area B1 at the seal diameter of the first valving element and the pressure-receiving surface area C1 at the effective diameter of the bellows of the first valving element are made equal to each other.

* * * * *